US007210275B2

(12) United States Patent
Guinchard et al.

(10) Patent No.: US 7,210,275 B2
(45) Date of Patent: May 1, 2007

(54) METHOD TO JOGGLE A STRUCTURAL ELEMENT AND STRUCTURAL ELEMENT JOGGLED ACCORDING TO THIS METHOD

(75) Inventors: Franck Guinchard, Pontchateau (FR); Yves Judic, Trignac (FR)

(73) Assignee: Airbus France SA, Toulouse (FR)

( * ) Notice: Subject to any disclaimer, the term of this patent is extended or adjusted under 35 U.S.C. 154(b) by 155 days.

(21) Appl. No.: 11/017,262

(22) Filed: Dec. 20, 2004

(65) Prior Publication Data

US 2005/0230551 A1 Oct. 20, 2005

(30) Foreign Application Priority Data

Dec. 18, 2003 (FR) ..... 03 51117

(51) Int. Cl.
*E04C 3/30* (2006.01)

(52) U.S. Cl. ..... 52/739.1; 52/730.6; 52/731.7; 52/737.6

(58) Field of Classification Search ..... 52/730.6, 52/731.7, 735.1, 737.6, 739.1; 29/897, 897.35
See application file for complete search history.

(56) References Cited

U.S. PATENT DOCUMENTS 2,767,763 A 10/1956 Anderson
5,203,193 A * 4/1993 Iguchi et al. ..... 72/225
5,671,630 A * 9/1997 Grober ..... 72/177
6,145,271 A * 11/2000 Kossmeier et al. ..... 52/735.1
6,420,014 B1 * 7/2002 Hartman ..... 428/156
6,434,908 B1 * 8/2002 Ferrante ..... 52/731.7

FOREIGN PATENT DOCUMENTS

AT 361 758 B 3/1981

* cited by examiner

*Primary Examiner*—Jeanette Chapman
(74) *Attorney, Agent, or Firm*—Patterson, Thuente, Skaar & Christensen, P.A.

(57) ABSTRACT

A joggled structural element includes two wings with a small thickness and a great thickness. Slopes made in a joggle of the structural element are computed as a function of each of the thicknesses of the wings. Thus, the joggled structural element comprises a shallow slope in the joggle on the side having the wing of great thickness and a steep slope in the joggle on the side having the wing of small thickness. A method is also disclosed implementing an anvil and a punch. This method can be used to make joggled structural elements.

4 Claims, 2 Drawing Sheets

METHOD TO JOGGLE A STRUCTURAL ELEMENT AND STRUCTURAL ELEMENT JOGGLED ACCORDING TO THIS METHOD

RELATED APPLICATION

The present application claims priority to French Application No. 03 51117 filed Dec. 18, 2003.

BACKGROUND OF THE INVENTION

1. Field of the Invention

The invention relates to a method to joggle a structural element and a structural element joggled according to this method. Joggling a structural element comprises joggling such a structural element so as to create an offset between two of its parts. In the context of the invention, the structural element to be joggled is a beam with any section whatsoever comprising, in its profile, a strut and wings at the two ends of this strut. The invention is aimed at reducing a length in the offset given by a joggling operation. The present invention can be applied to special advantage, but not exclusively, in the field of aeronautics.

A joggled structural element is generally used to strengthen a link between two parts, such as two parts of an aircraft that are not aligned with each other.

2. Description of the Prior Art

FIG. 1 shows a view of such a prior art joggled structural element 100. This structural element herein has an I-shaped section that could have any section whatsoever, such as a C-shaped or U-shaped section. This structural element 100 has a first wing 101, a second wing 102, and a strut 103. The first wing 101 has a thickness E1 and the second wing 102 has a thickness E2. This joggled structural element 100 is used to set up or reinforce a link between a part 121 and a part 122.

The first wing 101 and the second wing 102 are each deployed in a plane that forms a non-zero angle with a plane of the strut 103, itself located in the plane of the FIG. 1. In a particular embodiment, these wings 101 and 102 are each deployed in a plane that is perpendicular to a plane of the strut 103. There is a linking joggle 104 between a first part 105 and a second part 106 of the structural element. This joggle 104 corresponds to the part of the structural element 100 that is bent. This joggle 104 gives an offset between the first part 105 and the second part. 106. The offset extends in the plane of the strut 103 of the structural element with an offset height H measured along a direction perpendicular to the plane of the wings 101 and 102, and with an offset length L measured in a direction parallel to the planes of the strut 103 and of the wings 101 and 102.

This length L is computed as a function of a thickness of a wing. In one exemplary embodiment, for structural elements comprising wings 101 and 102 with equal thicknesses E1 and E2, the length L is on the whole equal to six times the thickness of a wing. This ratio between the thickness of a wing and the length L varies as a function of the material out of which the structural element is made. The length L is as short as possible but cannot be reduced as much as is desired. Indeed, the proportion of six times the thickness of the wing is a constraint that cannot be flouted without a risk of deterioration of the structural element.

In the prior art, when the thicknesses E1 and E2 of the wings 101 and 102 are different, the length L is computed from the thickness of the bigger of the two wings. In FIG. 1, the length L is therefore equal to six times the thickness E1 of the thick wing 101. In its joggle 104, the structural element 100 therefore has identical slopes on both sides of the wings 103 and 104.

The fact that the slopes are identical raises a problem. Indeed, the joggled structural element 100 is used to strengthen a link between two parts 121 and 122 having a difference in level. A space 130 depending on the length L can be seen between the parts 121 and 122 and the structural element 100. Since the length L of the offset given by the joggle is very great, the space 130 between the parts and the structural element is great. At the position of such a space 130, the joggled structural elements of the prior art therefore do not optimally participate in strengthening the link between the parts 121 and 122.

It is an object of the invention to resolve this problem of excessive space 130 between the structural element 100 and the parts 121 and 122.

SUMMARY OF THE INVENTION

To this end, the invention implements especially a joggled structural element comprising offset lengths computed as a function of each of the thicknesses of the structural element.

More specifically, the length of the offset given by the joggling of the side with the wing of great thickness is greater than the length of the offset given by the joggle on the side with the wing of small thickness. In the invention, these lengths are no longer identical.

The joggle in the joggled structural element according to the invention has a particular geometry in which the ends of the joggle form a quadrilateral resembling a trapezoid except for the slopes. In this quadrilateral, no side is parallel to another. Projections of the joggle ends on the side with the wing of small thickness are preferably located inside projections of the joggle ends on the side with the wing of great thickness.

In practice, the wing of small thickness is placed flat against two unaligned parts for which the link between them has to be reinforced. In one example of an embodiment, the length of the offset obtained by the joggling on the side with the wing of small thickness is equal to N times the length of the small thickness, while this length would have been equal to N times the length of the big thickness with a prior art joggling technique. With the invention, the space between the two linking parts and the joggled structural element is therefore limited. In one example, N is equal to six but varies as a function of the nature of the material out of which the structural element is made.

To make a joggled structural element, the invention implements a method in which a punch is used to press on a structural element wedged between this punch and an anvil.

More specifically, a punch is made with a part having low declivity that extends over a length proportional to the thickness of the wing of great thickness. An anvil is also made. This anvil has a part with high declivity that extends over a length proportional to a thickness of the wing of small thickness. The anvil is fixed. The punch is mobile.

After the punch and the anvil have been made, the side of the structural element with the wing of small thickness is placed against the anvil. Then, the punch is placed against the side of the structural element having the wing of great thickness. The punch is placed so that projections of ends of the part of the anvil having a slope in the sense opposite to a push or a pressure are placed between projections of the end of the part of the punch having a slope in the sense of the pressure. In particular embodiments, certain projections may be indistinguishable from each other.

Pressure is then applied to the punch in such a way that the structural element is compressed between the punch and the anvil. Since the slope segments of the punch and of the anvil are different, the shapes imprinted by this punch and this anvil on either side of the joggle of the structural element are different.

As a variant, the punch has a steep-sloped segment and the anvil has a shallow-sloped segment.

The invention therefore relates to a structural element with two wings and a strut, a first wing, whose plane forms a non-zero angle with a plane of the strut, being a wing of great thickness and a second wing, whose plane forms a non-zero angle with a plane of the strut, being a wing of small thickness, the structural element being formed with a linking joggle placed between a first part and a second part of the structural element, the joggle giving an offset between the first part and the second part, the offset extending in the plane of the strut of the structural section with a height measured along a direction perpendicular to the plane of the wings and with a length measured in a direction parallel to the planes of the strut and the wings, wherein the structural element comprises a shallow slope in the joggle of the side having the wing of great thickness, and a steep slope in the joggle of the side having the wing of small thickness.

BRIEF DESCRIPTION OF THE DRAWINGS

The invention will be understood more clearly from the following description and the accompanying figures. These figures are given by way of an illustration that in no way restricts the scope of the invention. Of the figures.

The elements common to the several figures keep the same references from one figure to another.

MORE DETAILED DESCRIPTION

Figure 1:
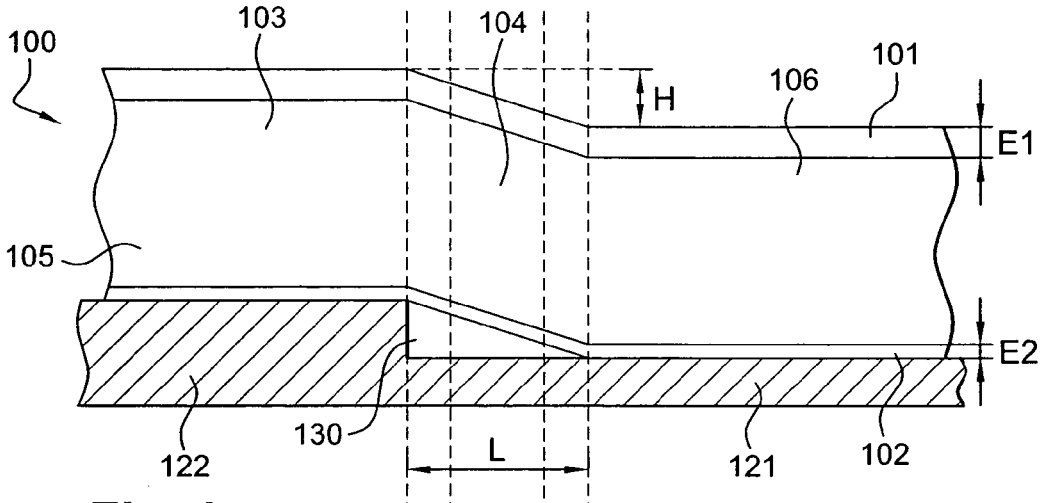
Fig. 1 PRIOR ART
FIG. 1 shows a prior art joggled structural element playing a role of a strengthening piece between two joined parts.
Figure 2:
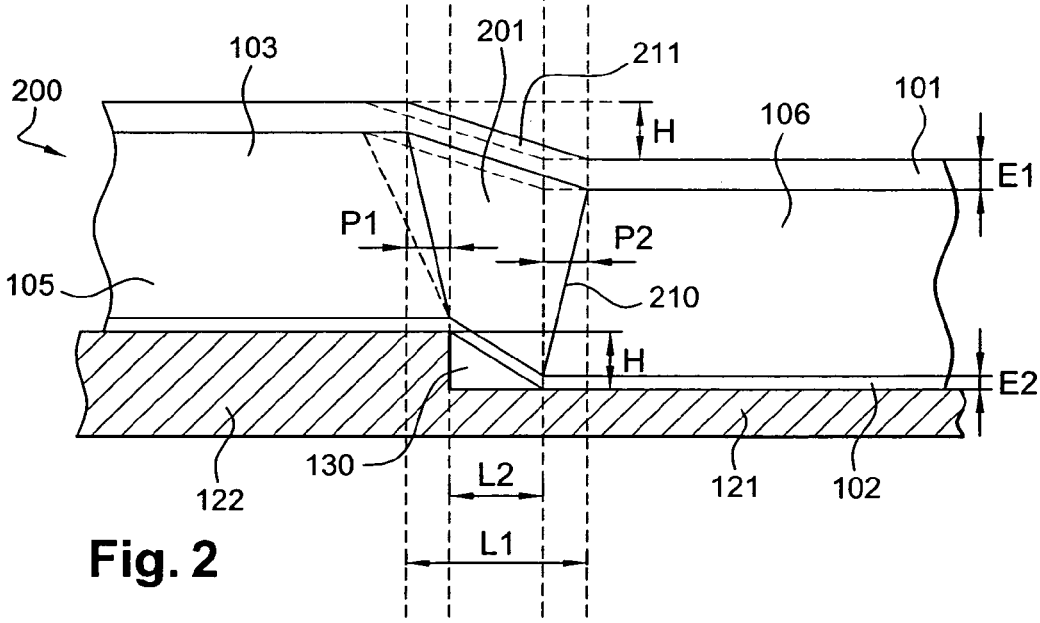
FIG. 2 shows a joggled structural element according to the invention playing a role of strengthening piece between two joined parts.

FIG. 2 shows the structural element 200 joggled according to the invention, comprising, as in FIG. 1, the strut 103, the first wing 101 of great thickness E1 and the second wing 102 of small thickness E2. This joggled structural element 200 plays a linking role between the parts 111 and 110, such as parts of an aircraft.

The linking joggle 201 gives an offset between the first part 105 and the second part 106 of the structural element 200. This offset is relative to a plane P of alignment between these two parts. This offset extends in the plane of the strut of the structural element with a height H measured along the direction perpendicular to the planes of the wings and with a length L1 or L2 measured in a direction parallel to the planes of the strut and of the wings.

The height H of the offset on the side with the wing of great thickness and that of the side with the wing of small thickness are identical. By contrast, the length L1 of the offset on the side with the wing 101 of great thickness is greater than the length L2 on the side with the wing 102 of small thickness. Thus, the structural section 200 has a shallow slope in the joggle 201, on the side with the wing 101 of great thickness, and a steep slope in the joggle 201, on the side with the wing 102 of shallow thickness.

In general, the length L1 is proportional to the thickness E1 of the wing 101 and the length L2 is proportional to a thickness E2 of the wing 102. In one example of an embodiment, the lengths L1 and L2 are respectively equal to six times the great thickness E1 and six times the small thickness E2. However, this ratio varies as a function of the nature of the material out of which the structural element 200 is made. However, the joggle 201 with a steep slope on the side with the wing 102 of small thickness, stretches between the two parts 105 and 106, on a length L2 equal to six times the thickness of this wing of small thickness. The joggle 201 with small thickness on the side with the wing of large thickness, extends between the two parts 105 and 106, on a length equal to six times the thickness of this wing of large thickness. The ratio between the lengths L1 and L2 and the thicknesses E1 and E2 may vary in an interval of real values ranging between four and ten.

Furthermore, in the joggled structural element according to the invention, projections of ends of the linking joggle 201, on the steep slope side, are located between projections of ends of the linking joggle 201 on the shallow slope side. More specifically, the ends of the joggle 201 on the side with the wing 102 of small thickness are projected along a direction perpendicular to the wings 101 and 102, and in a sense that goes from the small wing 102 to the large wing 101. The projections of these ends are located between projections of ends of the joggle 201 on the side with the wing 101 of great thickness, along a direction perpendicular to the wings 101 and 102, and in a reverse sense going from the large wing 101 to the small wing 102.

In one particular embodiment, a projection of an end of the joggle 201, on the steep slope side, along the above-mentioned direction and sense, is indistinguishable from a projection of an end of the joggle, on the shallow slope side, along the above-mentioned reverse direction and sense.

These projections may reveal a distance P1 and a distance P2. The distance P1, which stretches in a direction parallel to the planes of the strut 103 and of the wings 101 and 102, separates opposite ends of the joggle 201. A distance P2, that extends in the direction parallel to the plane of the strut 103 and of the wings 101 and 102, separates the other opposite ends of the joggle 201. In general, these distances P1 and P2 are different.

In the embodiment where the projections of ends are indistinguishable, the distance D1 or the distance D2 is zero. This embodiment is shown in dashes in the figure.

The joggle 201 thus has a completely different geometry from that of the joggle 104 of the structural element of FIG. 1. Indeed, the ends of the joggle 210 form a quadrilateral 210 wherein, contrary to a quadrilateral associated with the joggle 104, no side is parallel to another.

The geometry of the joggle 201 is determined as a function of a space factor, a geometry of an external system, or stops surrounding the structural element 300. The geometry can also be determined relative to a mechanical reinforcement indicated in a specifications sheet.

As compared with FIG. 1, the space 130 between the structural element 200 and the parts 121 and 122 are reduced so as to meet the requirements of an engineering and design department. In one example, this reduction of space meets the constraints related to a joining rigidity or a resistance between the parts 110 and 111.

FIG. 3 shows steps of the joggling method used to make the joggled structural element of FIG. 2. This method is implemented on a straight structural element 300 comprising wings 101 and 102 of great thickness and small thickness.

To obtain the joggled structural element 300, a fixed anvil 301 is made. This fixed anvil has a steep-sloped segment 302 stretching between two parts 303 and 304 parallel along the length L2. This length L2 is proportional to a thickness E2 of the wing 102 of small thickness.

Thus a punch 311 is made comprising a shallow-sloped segment 312 that stretches between two parts 313 and 314 parallel along a length L1. This length L1 is proportional to a thickness of the wing 101 of great thickness. In one implementation of the method, the lengths L1 and L2 of the steep-sloped and shallow-sloped segments 302 and 312 are respectively equal to N times the thickness of the wing 101 of great thickness and N times the thickness of the wing 102 of small thickness. N is a real number which, in one example, is equal to 6. However, N varies as a function of the nature of the material out of which the structural element 300 is made.

Figures 3A, 3B, 3C:
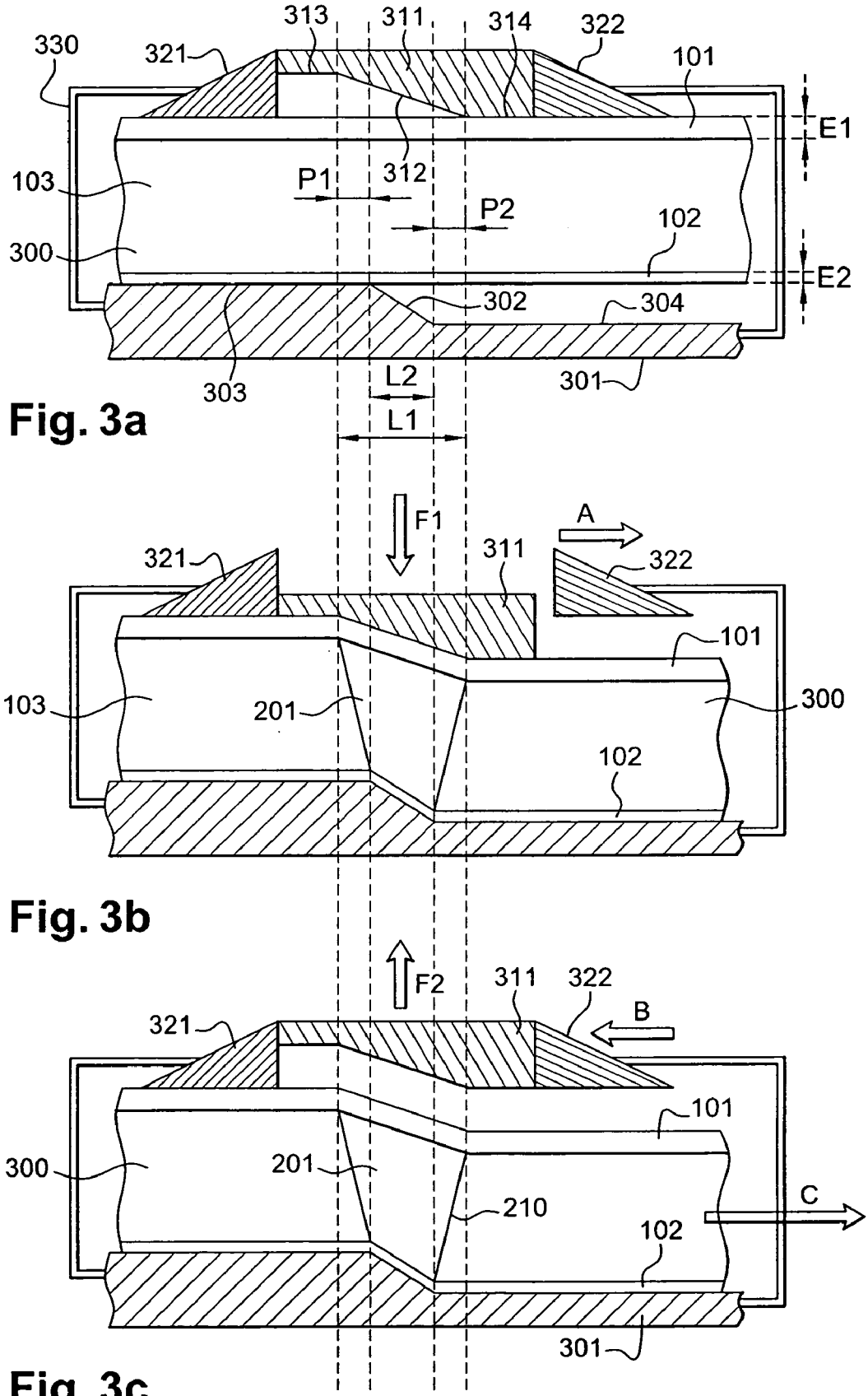
FIG. 3 shows a joggling method according to the invention.

FIG. 3*a* shows a step in which the wing 102 of small thickness of the structural element 300 is placed against the anvil 301. Then the punch 311 is placed against the wing 101 of great thickness of the structural element 300.

More precisely, ends of the steep-sloped end 302 are placed so that projections of the ends of the steep-sloped end 302 in the inverse sense of a push or pressure, are located between projections of the ends of the shallow-sloped segment 312 in the sense of the pressure. The punch 311 is then in an initial position.

In a particular implementation of the method, one end of the shallow-sloped segment 312 is placed so that the projection of this end is the same as the projection of an end of the steep-sloped segments 302.

A distance P1 is observed between an end of the steep-sloped segment 302 and an end of the shallow-sloped segment 312. A distance P2 is also observed between another end of the steep-sloped segment 302 and another end of the low-sloped segment 312. These distances are observed along a direction parallel to the plane of the strut 103 and of the wings 101 and 102. The length of these distances P1 and P2 can be adjusted by the positioning of shims 321 and 322.

These two shims 321 and 322 furthermore maintain the punch 311 when it is placed against the wing 101 of great thickness. The shims 321 and 322 and the anvil 301 are fixed and connected to each other by means of parts 330 that can be fixedly joined to a frame.

FIG. 3*b* shows a step in which a pressure is applied to the punch 311, so that this punch 311 and the anvil 301 imprint their shape on the structural element 300. To exert this pressure, the shim 321 is withdrawn laterally and pressure forces are exerted on the punch 311. These pressure forces F1 are applied along a direction perpendicular to the planes of the wings 101 and 102 and in a sense going from the wing 101 of great thickness to the wing 102 of small thickness. As a variant, the shim 321 is not withdrawn and the anvil slips between the two shims 321 and 322. More specifically, in this variant, the shim 322 does not shift laterally to release the punch. The punch 311 then has a degree of liberty enabling it to slide between the shims 321 and 322. The shims 321 and 322 hold the punch 311 solely when it is being placed and then allow it to shift during the application of the pressure.

These forces F1 are applied locally in a zone of the slope segments 302 and 312. As a variant, these forces F1 are not only applied in the zone of the slope segments 302 and 312, but also in a zone surrounding these slope segments 302 and 312. In applying the forces F1 in a zone that surrounds the segments 302 and 312, it is possible to obtain a more precise joggling, the slopes achieved in the joggling being very sharp. These forces F1 may be generated by means of a press or a jack. A screw or any other mechanical machine exerting mechanical forces may also generate these forces F1.

FIG. 3*c* shows a step in which the joggled structural element is released from the grip of the anvil 301 and the punch 311 used in the method. In this step, first of all pressure forces F2 opposite to the pressure forces F1 are exerted so that the punch 311 is no longer in contact with the structural element 300. Then, following the arrow B, the shim 322 is shifted so that the punch 312 is again blocked. As a variant, the shim 322 is not shifted laterally and the punch slides vertically between the shims 321 and 322 to return to an initial position. The shims 321 and 322 then have a configuration providing for a locking of the punch 311.

The initial structural section 300 is joggled according to the dimensions of the anvil 301 and the punch. Indeed, in the joggle 201, the slopes are formed on the side having the thick wing 103 and the side having the wing 104 of small thickness. Ends of the joggle 210 form the vertices of the particular quadrilateral 210. In the variant in which end projections are indistinguishable, namely where the distance P1 or the distance P2 is zero, the quadrilateral 210 has a side perpendicular to a horizontal plane.

Then, along the arrow C, the structural section 100 is released from the anvil 301.

Naturally, the slope segments 302 and 312 can be reversed. Thus, the punch 311 may comprise the steep-sloped segment 302 which extends over a length proportional to a thickness of the wing 102 of small thickness. The anvil 304 then has a shallow-sloped segment 312 which stretches over a length proportional to a thickness of the wing 101 of great thickness. The structural element 300 is then turned over so that each of its wings faces the slope segment that corresponds to it.

The structural element of the invention to be joggled herein has two wings but it could have more than two wings. The structural element to be joggled may, for example, have three wings or four wings that are parallel to one another, the joggled structural element obtained comprising the same number of wings. The punch then has a shape matching the number of wings of the structural element to be joggled. In a particular embodiment, the punch has several levels that get placed flat against the different wings of the structural element.

The joggling of the structural element can be done cold or hot. The determining of the temperature at which the structural element must be joggled depends on the shape of the section of this structural element and on the nature of the material out of which this structural element is made.

What is claimed is:

1. A structural clement having two wings and a strut, a first wing, whose plane forms a non-zero angle with a plane of the strut, having a first thickness, and a second wing, whose plane forms a non-zero angle with a plane of the strut, having a second thickness less than the first thickness, the structural element formed with a linking joggle arranged between a first part and a second part of the structural element, the joggle giving an offset between the first part and the second part, the offset extending in the plane of the strut of the structural section with a height measured along a direction perpendicular to the plane of the wings and with a length measured in a direction parallel to the planes of the strut and the wings, the structural element comprising:

a shallow slope in the joggle of a side having the first wing, and a steep slope in the joggle of a side having the second wing.

2. A joggled structural element according to claim 1, wherein projections of ends of the linking joggle on the steep-sloped side are arranged between projections of ends of the linking joggle on the shallow-sloped side.

3. A joggled structural element according to claim 1, wherein a projection of an end of the joggle on the steep-sloped side is indistinguishable from a projection of an end of the joggle on the shallow-sloped side.

4. A joggled structural element according to claim 1, wherein:

the steep-sloped joggle on the side having the second wing extends between the first and second parts on a length equal to about six times the second thickness, and the shallow-sloped joggle on the side having the first wing extends between the first and second pans on a length equal to about six times the first thickness.

* * * * *